US007322413B2

(12) United States Patent
Rogers et al.

(10) Patent No.: US 7,322,413 B2
(45) Date of Patent: Jan. 29, 2008

(54) EQUALIZER VALVE ASSEMBLY

(75) Inventors: Henry E. Rogers, Duncan, OK (US); David Durward Szarka, Duncan, OK (US); Brett A. Fears, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 305 days.

(21) Appl. No.: 11/182,401

(22) Filed: Jul. 15, 2005

(65) Prior Publication Data

US 2007/0012448 A1 Jan. 18, 2007

(51) Int. Cl.
*E21B 33/16* (2006.01)

(52) U.S. Cl. ..... 166/291; 166/177.4; 166/202; 166/324

(58) Field of Classification Search ..... 166/324, 166/291, 177.4, 373, 386, 202
See application file for complete search history.

(56) References Cited

U.S. PATENT DOCUMENTS

| | | | | |
|---|---|---|---|---|
| 4,421,165 | A | 12/1983 | Szarka | |
| 4,718,495 | A | 1/1988 | Lubitz et al. | |
| 4,917,184 | A | 4/1990 | Freeman et al. | |
| 4,949,788 | A | 8/1990 | Szarka et al. | |
| 5,137,087 | A | 8/1992 | Szarka et al. | |
| 5,375,661 | A | 12/1994 | Daneshy et al. | |
| 5,392,852 | A | 2/1995 | Laurel et al. | |
| 5,413,172 | A | 5/1995 | Laurel | |
| 5,472,053 | A | 12/1995 | Sullaway et al. | |
| 5,526,878 | A | 6/1996 | Duell et al. | |
| 5,641,021 | A | 6/1997 | Murray et al. | |
| 5,647,434 | A | 7/1997 | Sullaway et al. | |
| 5,735,348 | A * | 4/1998 | Hawkins, III | 166/285 |
| 5,738,171 | A | 4/1998 | Szarka | |
| 5,762,139 | A | 6/1998 | Sullaway et al. | |
| 5,829,526 | A | 11/1998 | Rogers et al. | |
| 5,971,079 | A * | 10/1999 | Mullins | 166/387 |
| 6,244,342 | B1 | 6/2001 | Sullaway et al. | |
| 6,497,291 | B1 | 12/2002 | Szarka | |
| 6,513,598 | B2 | 2/2003 | Moore et al. | |
| 6,547,007 | B2 | 4/2003 | Szarka et al. | |
| 6,651,743 | B2 | 11/2003 | Szarka | |

(Continued)

OTHER PUBLICATIONS

Foreign communication related to a counterpart application dated Sep. 22, 2006.

(Continued)

*Primary Examiner*—Hoang Dang
(74) *Attorney, Agent, or Firm*—John W. Wustenberg; Conley Rose P.C.

(57) ABSTRACT

A method for controlling a fluid pressure applied to a cementing plug comprises disposing the cementing plug within a casing string to define a trapped volume of fluid within the casing string, isolating a portion of the trapped volume of fluid adjacent the cementing plug to define an isolated volume of fluid, and relieving the fluid pressure within the isolated volume of fluid at a first rate sufficient to prevent damage to or inadvertent release of the cementing plug. An apparatus for relieving fluid pressure within a casing string being run into a well bore comprises at least one equalizer valve connected to a work string extending into the casing string, and a sealing device disposed above the equalizer valve to seal an annular space formed between the work string and the casing string.

18 Claims, 2 Drawing Sheets

U.S. PATENT DOCUMENTS

| | | | | |
|---|---|---|---|---|
| 6,725,935 | B2 | 4/2004 | Szarka et al. | |
| RE38,578 | E * | 9/2004 | Vercaemer et al. | 166/277 |
| 6,796,377 | B2 | 9/2004 | Butterfield, Jr. et al. | |
| 6,810,958 | B2 | 11/2004 | Szarka et al. | |
| 6,848,511 | B1 | 2/2005 | Jones et al. | |
| 2002/0084069 | A1 * | 7/2002 | Mosing et al. | 166/177.4 |
| 2002/0144813 | A1 | 10/2002 | Allamon et al. | |
| 2004/0020641 | A1 * | 2/2004 | Budde | 166/193 |
| 2004/0112588 | A1 * | 6/2004 | Mullins | 166/177.3 |

OTHER PUBLICATIONS

"4.13 SSR® Swivel/Equalizer"; Halliburton Casing Sales Manual on Cementing Plugs; Jul. 2003. (2 pgs.).
"SIP Tool (Selective Injection Packer) Cups, Packer Rings, & Shoes"; Data sheet; Jul. 1984. (1 pg.).
SIP Tool (Selective Injection Packer); Drawing and data sheet; Apr. 1983. (1 pg.).
"Retrievable Bridge Plug Two Cup—T.P. Cup Type"; Drawing; Apr. 1983. (1 pg.).
"Retrievable Tools"; Halliburton Services pamphlet. (2 pgs.).

* cited by examiner

EQUALIZER VALVE ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to apparatus and methods for relieving fluid pressure within a volume of fluid trapped within a casing string being cemented into a well bore. More particularly, the present invention relates to a cementing assembly comprising a sealing device that isolates a portion of the trapped volume of fluid, and methods for relieving fluid pressure within the isolated portion of fluid at a rate sufficient to prevent damage to or inadvertent release of a cementing plug.

BACKGROUND

To cement a string of casing into a well bore, a work string with one or more cementing plugs disposed at a lower end thereof extends into and connects to a casing running tool that suspends the casing string to be cemented. The work string runs the casing string into the well bore to the desired depth. Then a cement slurry is pumped downwardly through the work string, the casing string, and upwardly into the annular space formed between the casing string and the walls of the well bore. Upon setting, the cement bonds the casing string to the walls of the well bore and restricts fluid movement between formations penetrated by the well bore.

When the casing string is run into the well bore, the casing string fills with drilling fluid or other fluid in the well bore. To reduce contamination of the cement slurry at the interface with the drilling fluid, one of the cementing plugs is released from the work string and pumped ahead of the cement slurry. Specifically, a dart or other releasing device is dropped down the work string ahead of a batch of cement and the dart lands in a seat in one of the cementing plugs. The pressure behind the dart causes the cementing plug to be released as the cement pushes the plug down. The cementing plug thereby maintains a separation between the cement slurry and the drilling fluid until the cementing plug lands on a float collar or float shoe attached to the bottom end of the casing string. The cementing plug also sealingly engages the inner surfaces of the casing string to wipe the drilling fluid from the walls of the casing string ahead of the cement slurry.

The cementing plug that precedes the cement slurry and separates it from the drilling fluid is referred to herein as the "bottom cementing plug." When the required quantity of cement slurry has been pumped through the work string, a second cementing plug, referred to herein as the "top cementing plug", is released from the work string to separate the cement slurry from additional drilling fluid or other fluid used to displace the cement slurry through the casing string. Specifically, a wiper dart is launched from the surface to follow the cement, thereby wiping the cement from the walls of the work string, then landing in a releasing sleeve of the top cementing plug thereby releasing the top cementing plug to be pumped down the casing string.

When the bottom cementing plug lands on the float collar or float shoe attached to the bottom of the casing string, a bypass mechanism in the bottom cementing plug is actuated which allows the cement slurry to proceed through the bottom cementing plug, through the float collar or float shoe and upwardly into the well bore annulus between the casing string and the well bore wall. The design of the top cementing plug is such that when it lands on the bottom cementing plug, it shuts off fluid flow through the plugs, which prevents the displacement fluid from entering the well bore annulus.

During run in of the casing string into the well bore, before the cementing operation begins, the one or more cementing plugs allow drilling fluid or other well bore fluid to flow upwardly into an annular space formed between the casing string and the work string, but the cementing plugs prevent flow downwardly out of the annular space. Therefore, the annular space holds a trapped volume of fluid. Pressure can build in this trapped volume of fluid, and unless such pressure is relieved, it will exert a downward force on the one or more cementing plugs that could cause the plugs to be damaged and/or release from the work string prematurely.

Heretofore, one or more equalizer valves have been included in the work string to relieve the pressure in the trapped volume of fluid back into the work string. However, such equalizer valves may not relieve the pressure quickly enough to prevent damage to the cementing plugs when the trapped volume of fluid is large. Therefore, a need exists for an improved cementing assembly that will reliably relieve fluid pressure at a sufficient rate to prevent damage to and/or release of the one or more cementing plugs regardless of the volume of fluid trapped in the annular space between the casing string and the work string.

SUMMARY

In one aspect, the present disclosure relates to a method for controlling a fluid pressure applied to a cementing plug comprising disposing the cementing plug within a casing string to define a trapped volume of fluid within the casing string, isolating a portion of the trapped volume of fluid adjacent the cementing plug to define an isolated volume of fluid, and relieving the fluid pressure within the isolated volume of fluid at a first rate sufficient to prevent damage to or inadvertent release of the cementing plug. The first rate may be independent of the trapped volume of fluid. The trapped volume of fluid may be defined by the position of a casing running tool with respect to the cementing plug. The isolated volume of fluid may be defined by the position of the seal with respect to the cementing plug. In an embodiment, the isolating step comprises providing a seal within the casing string above the cementing plug. In an embodiment, the method further comprises varying the isolated volume of fluid based on the first rate. The method may further comprise relieving another fluid pressure within the trapped volume of fluid above the seal at a second rate, wherein the first rate is faster than the second rate. In another embodiment, the fluid pressure within the isolated volume of fluid is at least partially relieved through the seal into the trapped volume of fluid above the seal.

In another aspect, the present disclosure relates to a method for controlling a fluid pressure applied to a cementing plug comprising disposing the cementing plug within a casing string, defining a fixed volume of fluid within the casing string above the cementing plug regardless of the casing string size, and relieving the fluid pressure within the fixed volume of fluid at a rate sufficient to prevent damage to or inadvertent release of the cementing plug. The method may further comprise varying the fixed volume based on the rate. In an embodiment, the defining step comprises providing a seal within the casing string at a distance from the cementing plug. The method may further comprise defining a captured volume within the casing string above the seal, or relieving another fluid pressure within the captured volume. The another fluid pressure may be isolated from the cementing plug by the seal. In an embodiment, the fluid pressure within the fixed volume is at least partially relieved through the seal into the captured volume.

In yet another aspect, the present disclosure relates to an apparatus for relieving fluid pressure within a casing string being run into a well bore comprising at least one equalizer valve connected to a work string extending into the casing string, and a sealing device disposed above the equalizer valve to seal an annular space formed between the work string and the casing string. In various embodiments, the apparatus further comprises at least one cementing plug connected to the work string below the equalizer valve, or a casing running tool connected to the upper end of the casing string. The casing string may comprise a tapered casing string. In an embodiment, the at least one equalizer valve comprises a first equalizer valve above the sealing device and a second equalizer valve below the sealing device. The sealing device may comprise a cup type packer. In an embodiment, the cup on the packer may be inverted.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the present invention, reference will now be made to the accompanying drawings, wherein.

NOTATION AND NOMENCLATURE

Figure 1:
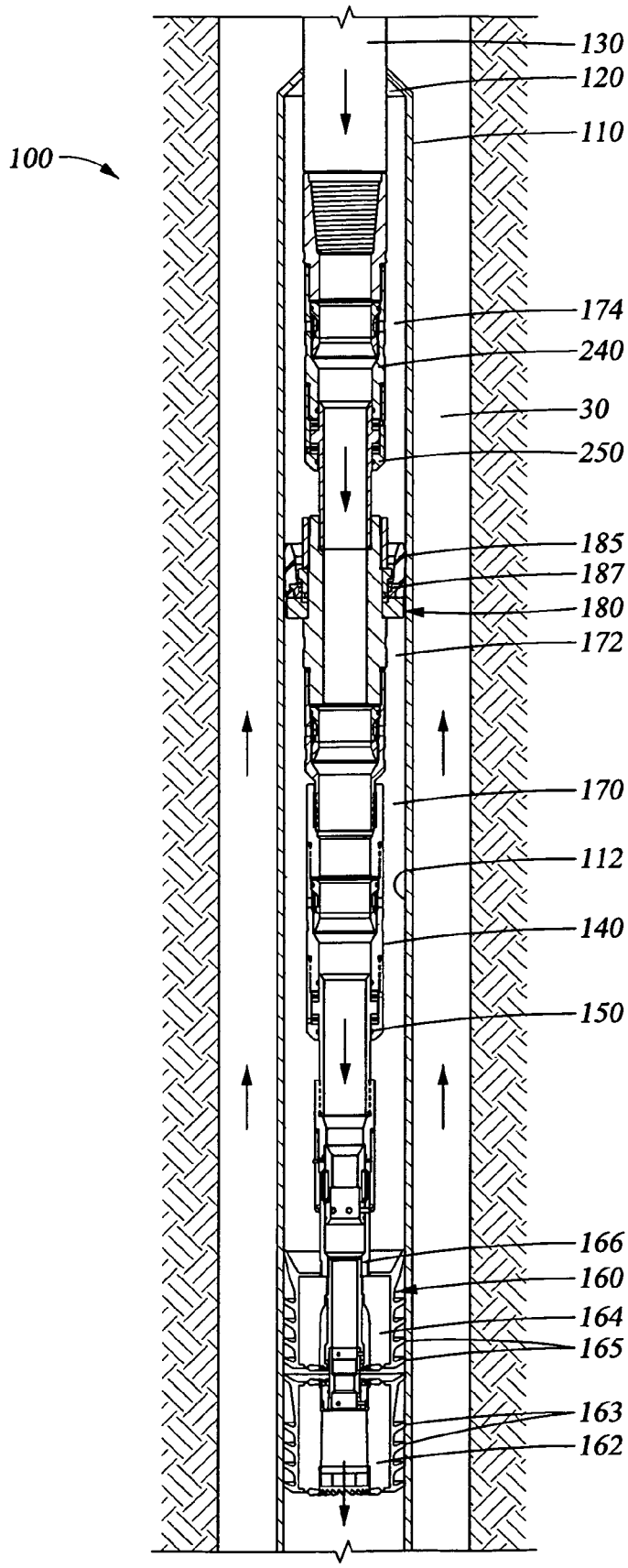
FIG. 1 is a schematic, cross-sectional side view of one embodiment of a cementing assembly of the present invention running a straight casing string into a well bore for cementing into place against the well bore wall.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and "down", "lower", or "downstream" meaning toward the bottom or terminal end of a well bore.

In the drawings, the cross-sectional side views of the cementing assembly should be viewed from top to bottom, with the upstream end at the top of the drawing and the downstream end at the bottom of the drawing.

DETAILED DESCRIPTION

Various embodiments of methods and apparatus for relieving fluid pressure within a casing string being run into a well bore, and various embodiments of an improved cementing assembly, will now be described with reference to the accompanying drawings, wherein like reference numerals are used for like features throughout the several views. There are shown in the drawings, and herein will be described in detail, specific embodiments of the improved cementing assembly with the understanding that this disclosure is representative only, and is not intended to limit the invention to those embodiments illustrated and described herein. The embodiments of the apparatus disclosed herein may be utilized in any type of cementing operation. It is to be fully recognized that the different teachings of the embodiments disclosed herein may be employed separately or in any suitable combination to produce desired results.

FIG. 1 depicts one embodiment of a subsurface cementing assembly 100 of the present invention running a straight string of casing 110 with a single diameter into a well bore 20 to be cemented against the well bore wall 25. The cementing assembly 100 comprises a casing running tool 120 that suspends the straight string of casing 110 therefrom, and a work string 130 that connects to the casing running tool 120 and extends into the casing string 110. Positioned along the work string 130 are an upper equalizer valve 240 with an optional swivel 250, a sealing device 180, a lower equalizer valve 140 with an optional swivel 150, and a subsurface released ("SSR") plug set 160 at the lower end thereof, all disposed within the casing string 110. Although any conventional type of equalizer valve 140, 240 may be employed, in an embodiment, each of the equalizer valves 140, 240 is combined with the corresponding optional swivel 150, 250 to comprise the "SSR Swivel/Equalizer", manufactured and sold by Halliburton Energy Services, Inc. of Houston, Tex., the assignee of the present application.

The SSR plug set 160 comprises a bottom plug 162 and a top plug 164 threaded onto a mandrel 166 that connects to the work string 130. The plugs 162, 164 each comprise a plurality of flexible wipers 163, 165, respectively, that sealingly engage the interior wall 112 of the casing string 110. An annular space 170 is formed radially between the work string 130 and the casing string 110. The annular space 170 is bound at its upper end by the casing running tool 120 and at its lower end by the SSR plug set 160, thereby defining a fixed volume within the annular space 170. The wipers 163, 165 of the plugs 162, 164 are configured to allow fluid flow upwardly but not downwardly therethrough, and therefore, the annular space 170 comprises a fixed volume where fluid may become trapped.

The cementing assembly 100 further comprises a sealing device 180 that extends radially across the annular space 170 to sealingly engage the interior wall 112 of the casing string 110. The sealing device 180 functions to separate the annular space 170 into a lower region 172 and an upper region 174, and more particularly, to limit the volume of fluid in the lower region 172 adjacent the SSR plug set 160, as will be discussed in more detail herein. The sealing device 180 may comprise any type of seal, such as a conventional two-piece packer, for example, comprising a rubber cup 185 molded onto a central metal ring 187. In one embodiment, the sealing device 180 comprises a "TP Cup", manufactured and sold by Halliburton Energy Services, Inc. of Houston, Tex., the assignee of the present application.

Figure 2:
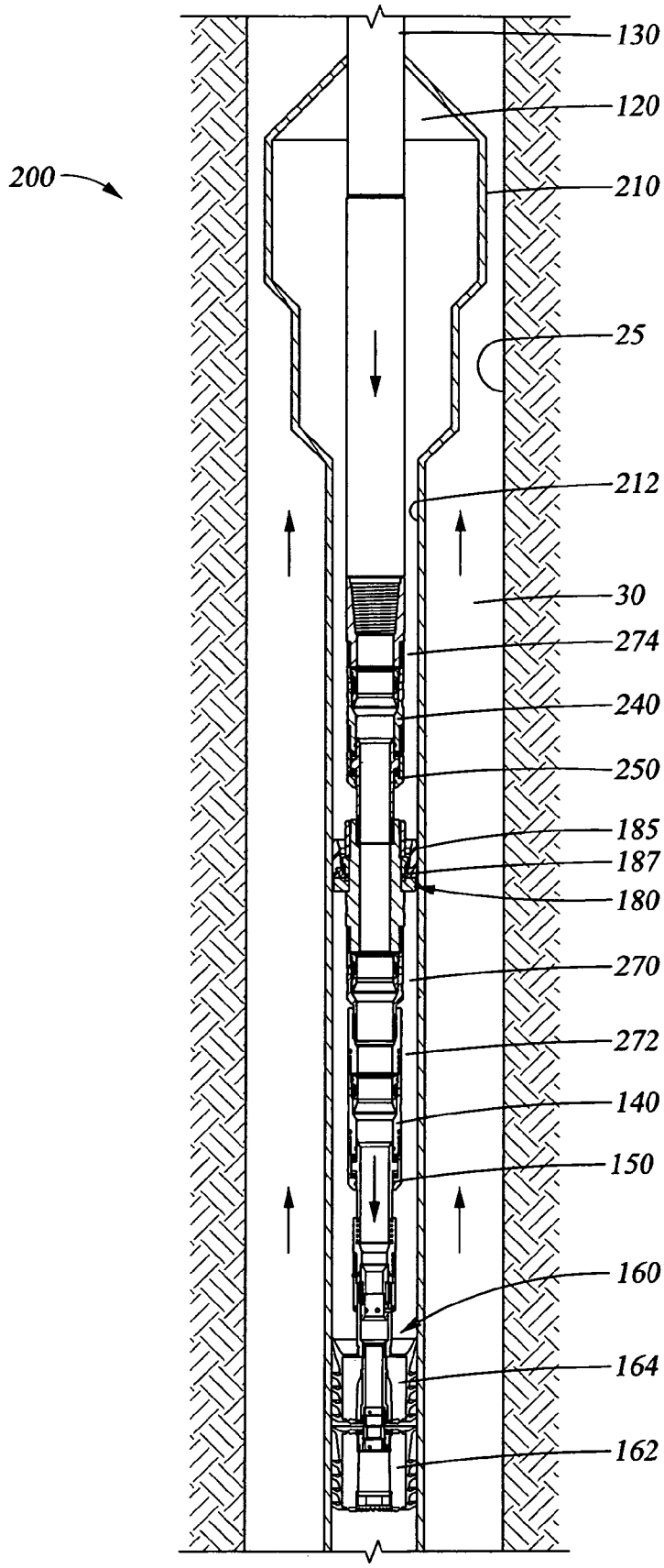
FIG. 2 is a schematic, cross-sectional side view of one embodiment of a cementing assembly of the present invention running a tapered casing string into a well bore for cementing into place against the well bore wall.

FIG. 2 depicts another embodiment of a subsurface cementing assembly 200 having many of the same features as the cementing assembly 100 of FIG. 1. Accordingly, like reference numerals are used to identify like components. FIG. 2 depicts the subsurface cementing assembly 200 running a tapered string of casing 210 having a plurality of different diameters into the well bore 20 to be cemented against the well bore wall 25. The cementing assembly 200 comprises the casing running tool 120 that suspends the tapered string of casing 210 therefrom, and the work string 130 that connects to the casing running tool 120 and extends into the casing string 210. The work string 130 includes the upper equalizer valve 240 with the optional swivel 250, the sealing device 180, the lower equalizer valve 140 with the optional swivel 150, and the SSR plug set 160 at the lower end thereof, all disposed within the casing string 210. An annular space 270 is formed radially between the work string 130 and the casing string 210. The annular space 270 is bound at its upper end by the casing running tool 120 and at its lower end by the SSR plug set 160. Again, because the wipers 163, 165 of the plugs 162, 164 are configured only to allow fluid flow upwardly but not downwardly therethrough, the annular space 270 comprises a fixed volume where fluid may become trapped. As depicted the sealing device 180 extends radially across the annular space 270 to sealingly engage the interior wall 212 of the casing string 210, thereby separating the annular space 270 into a lower region 272 and an upper region 274 so as to limit the volume of fluid in the lower region 272 adjacent the SSR plug set 160.

Tapered casing strings 210 have been introduced fairly recently and provide several advantages, especially in subsea well applications. For example, a tapered casing string 210 provides more flexibility in the wellhead selection, and fewer trips are required into the well bore 20 to install the casing. In general, a tapered casing string 210 provides a much larger internal volume than a straight casing string 110 for a given length of casing. Therefore, the annular space 270 formed between the work string 130 and the casing string 210 of FIG. 2 will typically be significantly larger than the annular space 170 formed between the work string 130 and the casing string 110 of FIG. 1.

In operation, when running either of the cementing assemblies 100, 200 of FIGS. 1-2 into the well 20, the well 20 is simultaneously being circulated. As represented by the flow arrows in each of FIGS. 1-2, circulating the well 20 comprises running pressurized drilling fluid through the work string 130, discharging the drilling fluid into the casing string 110, 210 and then around the lower end thereof to return to the surface within the well bore annulus 30 formed between the casing string 110, 210 and the well bore wall 25.

One purpose of circulating the well 20 is to condition the drilling fluid. After the well 20 has been drilled and the drill string removed, a water-based drilling fluid, for example, may sit in the well 20 for a long period of time before the casing string 110, 210 is run in. During this idle period, the drilling fluid will tend to become thicker, i.e. gain gel strength. Therefore, as the casing string 110, 210 is run into the well 20, it is appropriate to circulate drilling fluid into the well 20 to bring the rheological properties of the drilling fluid to acceptable levels. As the casing 110, 210 is being run into the well 20, the run-in operation will periodically be halted to break circulation until the casing string 110, 210 is lowered to the desired location.

Another purpose of circulating the well 20 is to condition the well 20. Specifically, as the casing string 110, 210 is being lowered and the well 20 is being circulated, the drilling fluid washes the casing 110, 210 past any bridges or other obstructions in the well bore 20. Such obstructions may result from the well 20 swelling, and circulating allows the casing string 110, 210 to be run through such swollen areas.

The drilling fluid must be pressurized to establish and maintain circulation in the well 20. Therefore, the entire casing string 110, 210 is filled with pressurized fluid, which can migrate upwardly past the wipers 163, 165 of the cementing plugs 162, 164 into the annular space 170, 270 in each of the assemblies 100, 200. Thus, the fluid within the annular space 170, 270 is energized during the circulation process. Once circulation is complete, the pumps are turned off at the surface, and the fluid pressure within the work string 130 and internally of the casing string 110, 210 rapidly drops off to reach static well bore pressure. However, the pressure of the energized fluid in the annular space 170, 270 does not drop off because the wipers 163, 165 of the plugs 162, 164, respectively, prevent fluid flow downwardly therethrough, so this pressurized fluid becomes trapped.

Although the example of circulating a well 20 has been discussed herein, one of ordinary skill in the art will readily appreciate that there are many other well bore operations in which pressurized fluid may become trapped in the annular space 170, 270. Therefore, it should be understood that the methods and apparatus described herein are not limited to any particular well bore operation, but are equally applicable to any operation where pressurized fluid may become trapped in the annular space 170, 270.

The pressure in the annular space 170, 270 must be relieved to prevent inadvertent launch and/or damage to one or both of the plugs 162, 164. Specifically, because the fluid is pressurized in the annular space 170, 270 above the SSR plug set 160, but there is only static well bore pressure in the casing string 110, 210 below the SSR plug set 160, a differential pressure is applied that may be sufficient to break one or both plugs 162, 164 away from the mandrel 166. The plugs 162, 164 may comprise plastic components that are only be capable of withstanding a few hundred pounds per square inch ("psi") of pressure, for example, whereas the pressure trapped within the annular space 170, 270 may exceed 1,000 psi, for example. Thus, the plugs 162, 164 could be prematurely launched and/or damaged due to the plastic portions of the plugs 162, 164 being stripped away from the mandrel 166 in response to the fluid pressure. This may occur when both plugs 162, 164 are still attached to the work string 130, or when only the top cementing plug 164 is attached and awaiting launch.

Accordingly, to relieve the pressure in the annular space 170, 270, each of the cementing assemblies 100, 200 comprises one or more conventional equalizer valves 140, 240 above the SSR plug set 160. These equalizer valves 140, 240 are configured to open when the fluid pressure within the annular space 170, 270 exceeds the fluid pressure within the work string 130. Thus, the equalizer valves 140, 240 will relieve the trapped fluid pressure into the interior of the work string 130, but they will not do so instantaneously. Therefore, to prevent damage to the SSR plug set 160, each of the cementing assemblies 100, 200 provide the sealing device 180, which expands radially into sealing engagement with the interior wall 112, 212 of the casing string 110, 210 to separate the annular space 170, 270 into an upper region 174, 274 and a lower region 172, 272, respectively. The lower region 172, 272 defines an isolated volume of pressurized fluid adjacent the SSR plug set 160. The sealing device 180 is axially positioned above the lower equalizer valve 140, which relieves the fluid pressure within the lower region 172, 272 of the annular space 170, 270.

The axial position of the sealing device 180 along the work string 130 thus defines the amount of trapped fluid that the SSR plug set 160 will be exposed to in the lower region 172, 272, and the remaining volume in the upper region 174, 274 is isolated from the SSR plug set 160 by the sealing device 180. Therefore, the sealing device 180 should be axially positioned to isolate a sufficiently small quantity of fluid within the lower region 172, 272 of each cementing assembly 100, 200 to enable the lower equalizer valve 140 to quickly relieve the pressure therein. As one of ordinary skill in the art will appreciate, the precise axial position of the sealing device 180 can vary so long as the equalizer valve 140 is operable to relieve the fluid pressure in the lower region 172, 272 quickly enough to prevent damage to, or release of, one or both of the plugs 162, 164. In one embodiment, the sealing device 180 is positioned substantially directly above the lower equalizer valve 140.

The sealing device 180 is capable of withstanding significant pressure, such that a single upper equalizer valve 240 is sufficient to relieve pressure in the upper region 174, 274 regardless of the volume trapped therein given that the pressure in that region 174, 274 does not need to be relieved quickly. Unlike the SSR plug set 160, which is made of plastic or other types of drillable materials, the sealing device 180 is made of materials that can withstand high pressures.

In the embodiment of the sealing device 180 shown in FIGS. 1-2, the cup 185 is angled upwardly with respect to the SSR plug set 160. Due to the shape of the cup 185 in this embodiment, the fluid pressure that is trapped in the lower region 172, 272 of the annular space 170, 270 may be partially relieved by migrating upwardly past the cup 185 into the upper region 174, 274 of the annular space 170. 270. Thus, the cup 185 provides a one-way seal that allows fluid pressure to flow upwardly past the seal but not downwardly. In the embodiment shown in FIG. 1-2, because pressure can migrate past the cup 185 into the upper region 174, 274 of the annular space 170, 270; an upper equalizer valve 240 is provided above the sealing device 180 to relieve pressure in the upper region 174, 274.

In an alternative embodiment, the cup 185 on the sealing device 180 may be inverted to prevent any migration of pressure past the cup 185 into the upper region 174, 274 of the annular space 170, 270. The inverted cup 185 provides a one-way seal that only allows fluid pressure to flow downwardly past the seal. Thus, in the alternative embodiment, all of the fluid pressure should be restricted to the lower region 172, 272 to be relieved by the lower equalizer valve 140, and an upper equalizer valve 240 may not be required.

The foregoing descriptions of specific embodiments of cementing assemblies 100, 200 and methods for relieving fluid pressure applied to a cementing plug have been presented for purposes of illustration and description and are not intended to be exhaustive or to limit the invention to the precise forms disclosed. Obviously many other modifications and variations are possible. In particular, the specific type and quantity of components of the cementing assemblies 100, 200 could be varied. For example, a different number of equalizer valves 140, 240 may be provided or the optional swivels 150, 250 may be eliminated. Further, the sealing device 180 may comprise a different design than the embodiments shown herein.

While various embodiments of cementing assemblies have been shown and described herein, modifications may be made by one skilled in the art without departing from the spirit and the teachings of the invention. The embodiments described are exemplary only, and are not intended to be limiting. Many variations, combinations, and modifications of the device and methods disclosed herein are possible and are within the scope of the invention. Accordingly, the scope of protection is not limited by the description set out above, but is defined by the claims which follow, that scope including all equivalents of the subject matter of the claims.

We claim:

1. A method for controlling a fluid pressure applied to a cementing plug comprising:

disposing the cementing plug within a casing string to define a trapped volume of fluid within the casing string;

isolating a portion of the trapped volume of fluid adjacent the cementing plug to define an isolated volume of fluid, wherein the isolating step comprises providing a seal within the casing string above the cementing plug;

relieving the fluid pressure within the isolated volume of fluid at a first rate sufficient to prevent damage to or inadvertent release of the cementing plug; and relieving another fluid pressure within the trapped volume of fluid above the seal at a second rate.

2. The method of claim 1 wherein the first rate is independent of the trapped volume of fluid.

3. The method of claim 1 further comprising varying the isolated volume of fluid based on the first rate.

4. The method of claim 1 wherein the trapped volume of fluid is defined by the position of a casing running tool with respect to the cementing plug.

5. The method of claim 1 wherein the isolated volume of fluid is defined by the position of the seal with respect to the cementing plug.

6. The method of claim 1 wherein the first rate is faster than the second rate.

7. A method for controlling a fluid pressure applied to a cementing plug comprising:

disposing the cementing plug within a casing string to define a trapped volume of fluid within the casing string;

isolating a portion of the trapped volume oil fluid adjacent the cementing plug to define an isolated volume of fluid, wherein the isolating step comprises providing a seal within the casing string above the cementing plug; and relieving the fluid pressure within the isolated volume of fluid at a first rate sufficient to prevent damage to or inadvertent release of the cementing plug, wherein the fluid pressure within the isolated volume of fluid is at least partially relieved through the seal into the trapped volume of fluid above the seal.

8. A method for controlling a fluid pressure applied to a cementing plug comprising:

disposing the cementing plug within a casing string;

defining a fixed volume of fluid within the casing string above the cementing plug regardless of the casing string size, wherein the defining step comprises providing a seal within the casing string at a distance from the cementing plug;

defining a captured volume within the casing string above the seal; and relieving the fluid pressure within the fixed volume of fluid at a rate sufficient to prevent damage to or inadvertent release of the cementing plug.

9. The method of claim 8 further comprising varying the fixed volume based on the rate.

10. The method of claim 8 further comprising relieving another fluid pressure within the captured volume.

11. The method of claim 10 wherein the fluid pressure is isolated from the cementing plug by the seal.

12. The method of claim 8 wherein the fluid pressure within the fixed volume is at least partially relieved through the seal into the captured volume.

13. An apparatus for relieving fluid pressure within a casing string being run into a well bore comprising:

at least one equalizer valve connected to a work string extending into the casing string; and a sealing device disposed above the equalizer valve to seal an annular space formed between the work string and the casing string, wherein the at least one equalizer valve comprises a first equalizer valve above the sealing device and a second equalizer valve below the sealing device.

14. The apparatus of claim 13 further comprising at least one cementing plug connected to the work string below the equalizer valve.

15. The apparatus of claim 13 further comprising a casing running tool connected to the upper end of the casing string.

16. The apparatus of claim 13 wherein the casing string comprises a tapered casing string.

17. The apparatus of claim 13 wherein the sealing device comprises a cup type packer.

18. The apparatus of claim 17 wherein a cup on the packer is inverted.

* * * * *